United States Patent [19]

Damhorst et al.

[11] Patent Number: 4,731,218

[45] Date of Patent: Mar. 15, 1988

[54] METHOD FOR PRODUCING FLAT POLYMERIC YARN

[75] Inventors: Hubert Damhorst, Neumünster; Karl-Heinz Erren, Aukrug-Homfeld; Hans-Joachim Petersen, Neumünster, all of Fed. Rep. of Germany

[73] Assignee: Norddeutsch Faserwerke GmbH, Neumunster, Fed. Rep. of Germany

[21] Appl. No.: 780,194

[22] Filed: Sep. 26, 1985

[30] Foreign Application Priority Data

Sep. 27, 1984 [DE] Fed. Rep. of Germany ..... 3435474

[51] Int. Cl.[4] ..... D01D 5/092

[52] U.S. Cl. ..... 264/555; 264/129; 264/130; 264/134; 264/210.2; 264/210.3; 264/210.8; 264/211.14

[58] Field of Search ..... 264/210.8, 129, 134, 264/177.1, 177.17, 210.3, 211.14, 555, 210.2, 130

[56] References Cited

U.S. PATENT DOCUMENTS

| | | | |
|---|---|---|---|
| 3,002,804 | 10/1961 | Kilian | 264/181 |
| 3,101,990 | 8/1963 | Heighton | 264/290.7 |
| 3,719,442 | 3/1973 | Schippers et al. | 264/210.8 |
| 3,899,562 | 8/1975 | Siedl | 264/210.8 |
| 3,975,484 | 8/1976 | Okada et al. | 264/210.8 |
| 4,093,147 | 6/1978 | Bromley et al. | 264/210.8 |
| 4,293,518 | 10/1981 | Bethay, Jr. | 264/210.8 |
| 4,301,102 | 11/1981 | Fernstrom et al. | 264/151 |

FOREIGN PATENT DOCUMENTS

| | | |
|---|---|---|
| 7605571 | 2/1976 | Fed. Rep. of Germany . |
| 2908404 | 9/1980 | Fed. Rep. of Germany . |

*Primary Examiner*—Jan H. Silbaugh
*Assistant Examiner*—Hubert C. Lorin
*Attorney, Agent, or Firm*—Bell, Seltzer, Park & Gibson

[57] ABSTRACT

A method of producing a flat polymeric yarn is disclosed which includes the steps of melt spinning a polymer to form a plurality of running filaments, combining the filaments to form a running bundle of filaments, and then guiding the running bundle into contact with a ribbon of fluid so as to apply a controlled quantity of the fluid to the bundle. The fluid coated bundle is guided over a plurality of serially arranged curved braking surfaces, and it is then withdrawn by means of a draw roll so as to draw the running bundle to an extent which exceeds its plastic limit. The application of the fluid to the bundle in accordance with the present invention results in a hydrodynamic friction, rather than a sliding contact friction, between the bundle and braking surfaces, and produces yarn of very uniform quality while also avoiding wear of the braking surfaces.

23 Claims, 6 Drawing Figures

METHOD FOR PRODUCING FLAT POLYMERIC YARN

This invention relates to a process and apparatus for producing a flat polymeric yarn.

Flat yarns of thermoplastic materials, in particular, polyester and polyamides, are conventionally formed by initially melt spinning a plurality of filaments, and then combining the filaments to form a yarn. Such flat yarns receive their properties for use, in particular their physical properties, by means of a drawing operation. Flat yarns, in contrast to textured yarns, are characterized in that the yarns are non-crimped, and their individual filaments lie parallel to each other and are of straight linear configuration, with no loops, bows, curls or the like.

U.S. Pat. No. 3,101,990 discloses a process for drawing polyester filaments, and wherein the undrawn filaments are looped about one or more snubbing pins, which may or may not be heated. It is believed that this process has a significant disadvantage in that the snubbing pins would be subject to wear. In addition, it has been found that the snubbing pins contribute to a substantial nonuniformity of the process at high yarn speeds, and yarn breaks are frequently observed. Another disadvantage of this prior method is that it produces a satisfactory yarn quality only when it is operated at speeds which are clearly less than 2,000 m/min, and when the yarn is guided in a defined manner by a draw roll positioned both upstream and downstream of the snubbing pins. Only then is it possible to obtain a uniform yarn quality, and this assumes that the unavoidable wear of the snubbing pins has been taken into account.

U.S. Pat. No. 3,002,804 discloses a drawing method by which a just-spun yarn is guided through a water bath, then deflected for the purpose of spraying off the water, and finally drawn due to the braking forces which are exerted by the water bath and the deflection. This method has a number of disadvantages, which have prevented it from being introduced to the industry. In particular, the yarn advancing at a high speed into the water bath forms a deep "hole", since it entrains large quantities of air which center around the yarn and do not escape. As a result, the yarn is not uniformly wetted, in that the wetting length fluctuates with the length of the air column, and a stable state of equilibrium does not develop between the uplift of the air and the adherence of the air to the yarn advancing at high speed. It has further been shown that the water bath needs to have a substantial depth, so as to exert the necessary tensile forces on the yarn. At a yarn speed of 3,000 m/min, the water bath needs to be more than 4 m deep, and at 5,000 m/min, the depth of the water bath should be 37 cm. Although this prior U.S. Patent indicates the possibility of applying a portion of the drawing tension by a subsequent deflecting pin, with the deflecting pin serving to spray off the water, it should be noted that this portion of the drawing tension should not be more than ⅓, since, otherwise, the uniformity of the yarn is affected. From the above it will be apparent that the disclosed method for the application of water to the yarn is so inadequate, that there is a mechanical sliding friction or a mixed friction between the deflecting pin and the yarn, which also contributes to the nonuniform condition of the yarn.

It is accordingly an object of the present invention to provide a method and apparatus for producing flat polymeric yarns, which avoids the above noted deficiencies and disadvantages of the prior art, This and other objects and advantages of the present invention are achieved in the embodiment illustrated herein by the provision of a method and apparatus which includes the steps of melt spinning a polymer into a plurality of running filaments, and then combining the filaments so as to form a running bundle of filaments. A quantity of a fluid is supplied onto a surface so as to form a relatively narrow ribbon of fluid, and the running bundle is then guided into contact with the ribbon of fluid so as to be in alignment therewith, and so as to apply a controlled quantity of the fluid to the bundle which exceeds the ability of the bundle to internally absorb the applied fluid. The ribbon is preferably elongated and relatively narrow, and has sufficient thickness so that its depth is greater than the diameter of the bundle of filaments. Thus the bundle is fully soaked, and the external surface of the bundle is surrounded by a fluid coating.

The internal absorption is specifically defined by the molecular absorption of the polymer for the fluid, and by the absorption resulting from the capillary action between the individual filaments of the bundle. The absorption between the individual filaments of the bundle usually amounts to about 15 percent of the filament volume when the filaments are in their closest arrangement. As a result, the present invention provides that the controlled quantity of the fluid which is applied to the bundle is at least about 20 percent of the weight of the bundle, and preferably between about 25 to 35 percent of the weight of the bundle. The fluid applied to the bundle may have a temperature more than about 50° C., and preferably a temperature ranging between 70° to 90° C.

The fluid which is applied to the bundle may be supplied for example, through nozzles, which terminate on the surface of a guide member in an upwardly open groove (see, e.g., German Utility Model GM No. 76 05 571). The guide members of such nozzles measure 30 to 40 mm long.

Since a nozzle terminates closely to the bundle entry on the guide member, the fluid is drawn over the guide member to form a ribbon of fluid which extends in the direction of the advancing yarn, which ribbon is very narrow in a direction transverse to the yarn. This limited width is further defined in that the guide member is provided with a yarn groove, with the nozzle terminating in the groove.

Known rolls, which are partially looped by the yarn, may also serve for a metered supply of the fluid stream, provided steps are taken to prevent the fluid from spreading on the roll to a wide film. Rather, a laterally defined ribbon of fluid should be formed, which is supplied in a metered quantity and through which the bundle of filaments advances. Such a roll is, for example, known from German OS No. 29 08 404. Likewise, rolls which have yarn guide grooves over their circumference to which a metered quantity of fluid is supplied, work satisfactorily for the purpose of the present invention. In any event, the fluid forms a narrow ribbon through which the yarn advances. For this reason, the fluid is not supplied in a very confined tube, as is the state of the art, but is applied to a surface as a ribbon. Also, the bundle should not be immersed into a static fluid bath, since the bath will not provide a defined, uniform application of the fluid.

The method of the present invention includes the further subsequent steps of guiding the fluid coated bundle over a plurality of serially arranged curved braking surfaces, with the direction of curvature alternating between adjacent braking surfaces. Finally, the bundle is withdrawn from the braking surfaces by draw roll means, and so as to draw the running bundle to an extent exceeding the elastic limit of the bundle, with the elastic limit being defined as the point where the elasticity of the material ends and permanent elongation sets in. Preferably, the running bundle is advanced at a speed of greater than 1000 m/min to the braking surfaces, and the draw roll means imparts a speed of greater than 3500 m/min to the bundle. Further, a suitable yarn finish may be applied to the bundle either prior or subsequent to contacting the bundle with the draw roll means.

The application of the fluid in the form of a ribbon to a surface of the bundle serves, on one hand, the purpose of exerting sufficient adhesive forces on the fluid, so as to prevent the fluid from being carried off by the bundle in drops, and so as to produce an uneven application. In addition, this adhesion is only effective on one side of the fluid ribbon, and does not prevent the fluid from being "drawn out" by the bundle, as a result of the cohesive forces, to a continuous band surrounding the yarn, and removed by the bundle from the surface.

To carry out the invention, any low-viscosity, textile-technologically acceptable fluids may be used. The main ingredient of a plurality of these fluids is water, and by reason of its good wettability, pure water may advantageously be used. It is also preferred that the water not contain any significant amount of additives, such as, for example, oils, which are normally used for moistening and finishing a yarn. In the present invention, the portion of these additives should be less than 5%, preferably less than 1% by weight.

The wettability of the water may be enhanced by adding a wetting agent. The portion of the "wetting agent" (liquid or other additives for diminishing the cohesion and hardness of the water) should be less than 1%, preferably less than 0.5% by weight. The "wetting agent" aids, in particular, in uniformly impregnating or soaking the yarn throughout its entire cross section.

The use of pure water, or also of water to which a small quantity of wetting agent is added, has the particular advantage over other oils, finishes, emulsions and the like, as are used in textile technology, in that the water is always available in a consistent condition, and thus the method becomes reproducible without deviations.

An advantage in the use of water, in particular when heated, is its low viscosity. For this reason, it is preferred to use fluids which have a viscosity lower than, or identical to, the viscosity of water, or which consists essentially of water, so that their dynamic properties are substantially determined by the portion of water in the fluid.

As indicated above, the fluid coated bundle of filaments is drawn over several curved braking surfaces, one following the other in the bundle path of travel, and which are curved in alternating directions. By the curvature of the braking surfaces, it is accomplished that the bundle can be pulled over the braking surfaces with a normal force acting between the bundle and each surface. This normal force counteracts the hydrodynamic buoyancy, and provides that the fluid thickness between the braking surface and bundle remains small. Dependent on this fluid thickness is the shearing gradient, and thus also the braking force, which is exerted on the bundle by the fluid. The radius of curvature may be, for example, 10 mm, however, radii of less than 10 mm and up to 50 mm have been found satisfactory. The curvature also defines the normal force of the bundle directed against the braking surface, so that the hydrodynamic forces, as they develop at each bundle speed, ensure a "floating" of the bundle, while also providing that a small depth of the fluid thickness is maintained.

In other words, the normal forces need to be of such magnitude that the hydrodynamic fluid thickness remains so small that a large shearing gradient develops between the bundle advancing at a high speed and the stationary braking surface. It should here be noted that the bundle, as it travels over a curved braking surface, is also subjected to the centrifugal forces, which tends to be opposite to the normal force. On the other hand, the curvature should not be of a size to allow the normal forces developing from the tensile forces to overcome the hydrodynamic buoyancy of the bundle, and lead to a sliding friction. Even mixed ranges between the fluid friction and sliding friction are undesired, since the frictional forces are here undefined, and will also exert undesired tensile forces on the bundle.

As the wet bundle passes over a braking surface, there is also the problem of the fluid leaving the gap between the bundle and the braking surface due to the operative centrifugal force, and collecting in the bundle areas which are on the side of the bundle opposite from the braking surface. For this reason, as the braking surface increases in length, there is the risk of a dry friction occurring. With the present invention, several and preferably more than two, braking surfaces be arranged, one following the other, and which are respectively looped by the bundle at less than 140° and in alternating looping directions. This arrangement provides that the fluid, which wells up from the gap of contact between the bundle and the braking surface as the yarn passes over the first braking surface, and which is on the external surface of the bundle, penetrates into the gap between the bundle and the next braking surface, as the bundle passes over the same. It may also be quite useful to arrange an oppositely curved braking surface which projects into the bundle path and has a smaller radius of curvature and a shorter contact surface, between two identically curved braking surfaces. This braking surface will then exclusively serve to redistribute the applied fluid, while the braking surfaces with a larger radius of curvature and a greater length serve to generate the desired braking force.

In the yarn path, the braking surfaces preferably overlie each other, with the bundle path deviating from the vertical between two braking surfaces not more than 70°, and preferably by not more than 60°. This provides that the fluid, which sprays off the bundle as it loops the braking surface, is sprayed in the direction of the following braking surface, and is thereby to a large extent returned to the bundle path. In addition, a successive arrangement of several braking surfaces has also been shown to maintain a fluid friction between the bundle and the braking surfaces right to the end. This is based upon the fact that the loopings are relatively small, so that only relatively small quantities of water spray off, and the quantity of water remaining on the bundle suffices to surround the surface of the bundle, which becomes smaller due to drawing, and to fill the decreasing spaces between the filaments.

The present invention thus provides that the presently usual dry friction is replaced by a hydrodynamic friction in a narrow fluid thickness or gap. As a result, the drawing process becomes independent of the surface condition of the braking surfaces, and of the yarn. Rather, the braking force is produced, in the case of wet friction, by the shearing gradient within a thin layer of fluid. This shearing gradient is largely independent of the bundle tension.

In contrast to the drawing in a water bath, the present invention provides that that the bundle is subjected to a defined braking length, and that the shearing gradient in the fluid gap which causes the braking, is so great, that, even at withdrawal speeds of only 3000 m/min, a braking length of 100 mm is sufficient to exert the desired drawing forces.

To achieve the fluid friction, the bundle needs to advance to the braking surfaces at a certain minimum speed. This minimum speed is usually about 1000 m/min. However, higher speeds, are preferable, such as at least about 1800 m/min. When the speed of the bundle, as it contacts the first braking surface, is at least about 2500 m/min, the bundle receives already a greater partial orientation before it contacts the braking surfaces. As a result, the method becomes less variable with regard to adjustment of the process parameters.

The overall length of the braking surface which is required to exert the drawing force, is best found by trial and error. Braking surface lengths of more than 200 mm have been found to be unnecessary. The length of the braking surface is primarily adapted to the predetermined bundle speeds before and after the braking surfaces, as well as the desired bundle tensions and draw ratios.

The length of the total braking surface, which is contacted by the bundle, can be adjusted by means of the looping angle. To this end, the distance which the curved braking surfaces penetrate into the bundle path may be adjusted. The looping in the present invention is small, and preferably amounts on the first and the last braking surface to no more than 70°, preferably less than 60°, and on the braking surfaces arranged in between, preferably to no more than 140°, and preferably to less than 120°.

Aside from the looping angle, the overall length of the braking surfaces may be adjusted in that an appropriate number of such braking surfaces may be serially arranged, which are looped by the bundle in alternating direction, and without requiring significant additional space.

Highly significant for the production of a high-quality flat yarn is the adjustment of the bundle tension between the braking surfaces and the downstream draw rolls (godets). Quality parameters, which correspond to the quality of yarns produced on draw twisters, are obtained by providing a tension which ranges from 0.5 to 2 cN/dtex, preferably, from 0.7 to 1.5 cN/dtex, which may be achieved by the adjustment of the braking force and the speed of the draw rolls.

To define the bundle path, the braking surfaces may be provided with a groove. However, the braking surfaces should contact the bundle or the layer of fluid surrounding it on only one side. In other words, the braking surfaces should not enclose the bundle. Otherwise, undefined contact conditions arise, which result in undefined, variable braking forces being exerted on the bundle. For this reason, narrow tubes, for example of the type disclosed in U.S. Pat. No. 3,002,804, are totally unsuitable as contact surfaces with the present invention, even if they were curved in the direction of the advancing bundle. Also, such tubes are disadvantages as to operation and service.

The temperature of the fluid applied to the bundle may also be a factor in the production of high-quality yarns. As is known, the deformation energy developing during the drawing process is converted to heat. As a function of the drawing speed, this heat leads to either a greater or lesser temperature. However, in view of the presently desired high yarn speeds from a technological and economical point, and the low yarn deniers, the released amounts of heat lead to temperatures which are technologically no longer acceptable.

This situation is obviated by the method of the present invention, in that the fluid supplied to the bundle is heated before it passes over the braking surface. The temperature corresponds approximately to the temperature of the first order transition temperature, and is more than about 50°. It is particularly effective when the temperature is higher than about 70° C., whereas an upper limit is about 100° C., by reason of the then occuring evaporation.

The excellent uniformity of the yarn quality that is thus obtained with the present invention, may be attributed in part to the fact that the temperature of the fluid serves to limit the temperature fluctuations of the surface of each filament, as well as along its length, to a narrow, physically optimal range. This range of fluctuation is between the actual temperature of the fluid and the evaporation temperature of the fluid.

The reliability of the method, primarily in the production of textile denier yarns, is further enhanced when the bundle of filaments advancing from the spinneret is guided through the fluid ribbon while it is still heated. The cooling conditions are here so predetermined that the bundle temperature is in the range of the first order transition temperature. The intensity of the air blown on the yarn, the length of the cooling zone, the distance of the fluid band from the spinneret, and the spun denier of the filaments are all factors in these cooling conditions. The proper cooling conditions are believed to drastically reduce the yarn breakage and to significantly improve the uniformity of the yarn. Also, it is preferred that the cooling conditions be designed to uniformly cool the peripheral surface of each filament to a uniform temperature.

It has further been found that, in particular at high spinning speeds and corresponding cooling conditions, the amount of heat carried by the bundle is sufficient to very rapidly heat the quantity of fluid applied to the bundle to the specified range of temperature. This temperature range essentially corresponds to the first order transition temperature, in the case of polyester or polyamide. As a result, the utilization of such spinning and cooling conditions permits the water to be applied to the bundle at room temperature.

The yarn quality may be further improved, in particular with regard to its physical and shrinking properties, by again heating the bundle downstream of the contact surfaces. In one embodiment, the conveying means is designed as a heated draw roll (godet). The godet temperature is adjusted, depending on the polymer, to between about 80° to 160° C. An advantageous temperature for polyester has been found to be 140°±20° C., and for polyamide to be 100°±20° C.

It is further provided by the present invention that the normal spinning finish, which consists in particular of water oil emulsions, may be applied to the filament bundle or yarn following the drawing, and preferably before the delivery rolls. Also this step enhances the reliability of the method.

U.S. Pat. No. 4,301,102 to DuPont discloses a method for producing self-crimping yarns, in which the just-spun filaments with a surface temperature of about 80° C. are wetted with an aqueous fluid and then drawn over two braking pins with alternating looping. The crimps obtained by this method are said to be produced in that the filaments are asymmetrically quenched by a cross flow of air in the spinning zone. However, in the present invention, the filaments are not so quenched in the spinning shaft. Rather, normal, uniform cooling conditions are provided. A quenching would contradict the result desired by the present invention, inasmuch as the filaments preferably carry a sufficient amount of heat when the fluid is applied.

The DuPont patent further provides that the fluid is applied to the parallel advancing individual filaments as an axially extending, relatively thin film. More particularly, the filaments are guided onto the applicator roll in the form of a sheet of side-by-side running filaments, and the amount of fluid which is absorbed is relatively small. It is believed that this type of fluid application would not allow the fluid to sufficiently coat the filaments, and so as to result in a hydrodynamic friction on the subsequent braking pins in the manner of the present invention.

Also, the DuPont patent provides for the production of yarns having a relatively high residual elongation (elongation at break) which is only acceptable in the case of crimped yarns for specific end uses. Such elongation is entirely unsuitable for flat yarns. Further, the DuPont patent fails to apply the braking forces by hydrodynamic resistance. Since the braking forces are applied by mechanical friction, they are seen to be subject to high fluctuations. For this reason, it is believed that only yarns with a high residual elongation can be produced according the DuPont patent. Where flat yarns are to be produced which have elongation values of less than about 30 percent, and which are, therefore, subjected to a tensile stress of more than 0.5 cN/dtex between the braking pin and the delivery roll (godet), it will be necessary to use a hydrodyamic braking as provided by the present invention.

The present invention is based on the new recognition, which is not apparent from the state of the art, that the buildup of a hydrodynamic gap friction in the draw zone, permits the production of flat yarns which are far superior in their quality, and also in their industrial operation or utility, to the flat yarns normally produced on draw twisters. Further, the occurrence of lint at a ratio of 10:1 is lower in comparison to comparable drawtwisted yarns of the same denier and same number of filaments. Also, the so-called Uster evenness is substantially improved, and the yarns are less expensive due to the lower capital expenditure and the higher productivity. Also noteworthy is the fact that the wear on the braking surfaces is absent, and that even drag marks do not become visible.

Some of the objects and advantages of the present invention having been stated, others will appear, when taken in conjunction with the accompanying drawings in which FIG. 1 is a schematic view of a spinning head and processing apparatus in accordance with the present invention;

Figure 1:
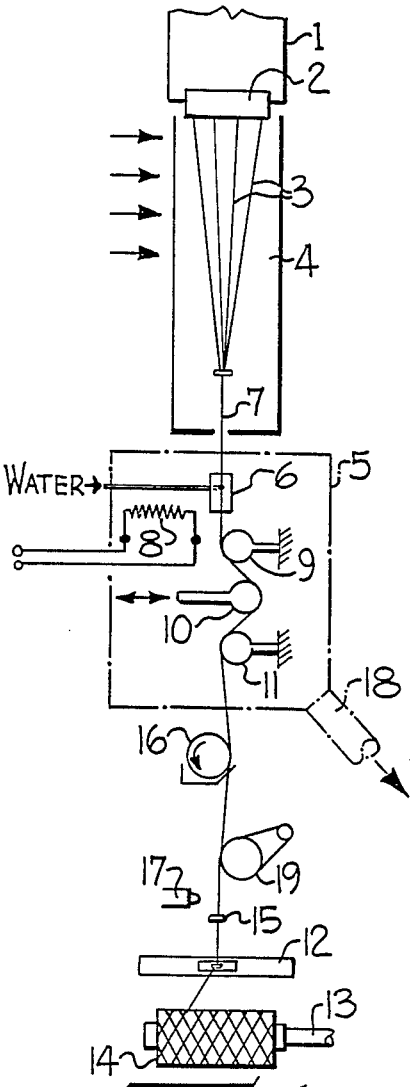

Referring more particularly to the drawings, FIG. 1 illustrates at 1 the spinning head of an extrusion melt spinning installation. A plurality of filaments 3 exit from spinneret 2, which are cooled by blowing air, and then combined to form a bundle of filaments in cooling shaft or chute 4. The bundle is then conducted into a closed box 5, which contains a nozzle 6 through which water is applied to the bundle. A heater for the water is indicated at 8.

Figure 2:
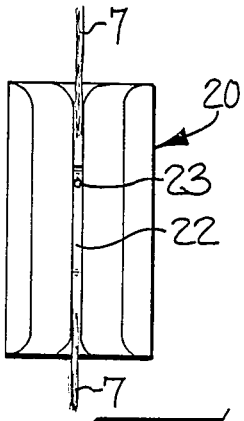
FIG. 2 is a front elevation view of a fluid applying nozzle in accordance with the present invention.
Figure 4:
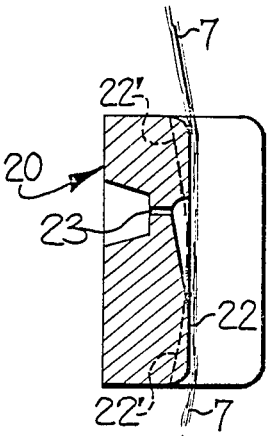
FIG. 4 is a sectional side elevation view of the nozzle shown in FIG. 2.
Figure 3:
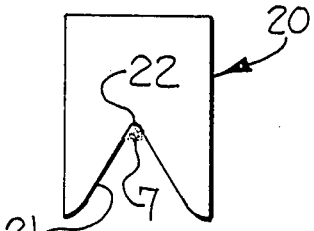
FIG. 3 is a top plan view.

The water applying nozzle 6 is illustrated in FIGS. 2–4, and is similar to the one disclosed in German utility model No. 76 05 571. The nozzle 6 comprises a body 20 which is generally rectangular in cross section, and which includes a U-shaped groove 21. The base of the groove provides the running surface 22 for the bundle of filaments 7. This surface includes arcuate ends, and an orifice 23 communicates with the running surface. The orifice 23 is in turn connected to a pump or similar means (not shown) for supplying water in a metered quantity. The width of the surface 22 and the groove is not critical, but the width should be adjusted to the diameter of the filament bundle running therethrough. The water emerging from the orifice 23 into the groove will be drawn into a ribbon of fluid, which extends along the surface downstream of the orifice.

The nozzle 6 may include a groove which is curved both in the direction of the advancing, as well as transversely thereto. Thus for example, the bottom or running surface 22 of the groove as seen in FIG. 3 may have a slight curvature which is transverse to the direction of the filament bundle, and the surface 22 may be provided with a large radius of curvature in the direction of the advancing bundle as shown in dashed lines at 22′ in FIG. 4. The radius of curvature in direction of the advance may be about 40 mm, and the radius of curvature transversely to the advance may be about 10 mm. This curvature assures that the filaments are combined to a bundle when they reach the area of the incoming water supply duct.

After the water applying nozzle 6, the bundle 7 passes over three parallel, cylindrical braking surfaces 9, 10, 11. Braking surface 11 serves as a deflecting surface, and causes the bundle to move along a zig-zag path between the braking surfaces 9, 10. Since braking surface 11 is movable perpendicularly to the yarn path, it can also extend to varying depths into the common tangential plane of the braking surfaces 9 and 10. As a result, the looping angle, and thus the length of contact, can be adjusted on each braking surface 9–11. The radius of curvature of the braking surfaces is preferably about 10 mm.

Box 5 possesses an outlet 18, through which the draining fluid may be collected, and possibly returned to the process. A spin finish is applied to the bundle advancing from the contact surfaces by an applicator roll 16, prior to its being withdrawn by heated draw roll or godet 19. The spin finish may also be applied in the box 5, for example by an applicator nozzle which substantially corresponds to water applying nozzle 6.

The application of the spin finish may occur downstream of the godet 19. However, it is advantageous to apply the spin finish upstream of the godet, since the yarn runs smoother on the godet, and as a result, the method becomes more reliable, and the uniformity of the yarn is further improved.

It may happen, depending on the kind of spin finish, that sediments of the spin finish are deposited on the surface of the godet, when heated to more than 100° C. In this case, it is advisable to install the spin finish applicator downstream of the godet 19.

As a final step of the illustrated method, the resulting yarn is wound into a package 14. The winding apparatus includes a spindle 13, a yarn traversing system 12, and a yarn guide 15 from which the yarn advances to the traversing system. 17 indicates a so-called air entangling nozzle, by which the individual filaments are interlaced in individual knots. This nozzle has been found useful to obtain satisfactory packages and to improve the further processing of the multi-filament yarn which should not be twisted when carrying out the present invention. The yarn takeup may also be replaced by a different type of yarn storage, such as cans which receive the yarn. Additional means for modifying the yarn, such as for example a cutter, may be arranged between the godet and the storage. Likewise, it is possible to subject the produced flat yarn to texturing, for example, by entangling the filaments with an unheated air jet or by crimping them in hot steam. However, the thus produced flat yarn is ready for use as a "draw twisted yarn" without such interposed intermediate processing steps.

Figure 5:
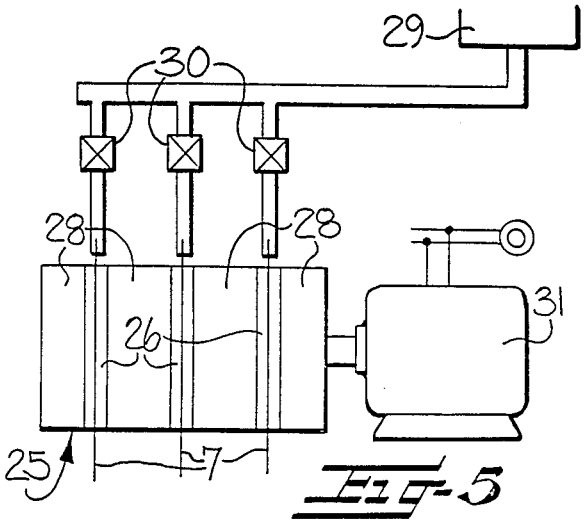
FIG. 5 is a schematic front elevation view of a fluid application roller which is suitable for use with the present invention.
Figure 6:
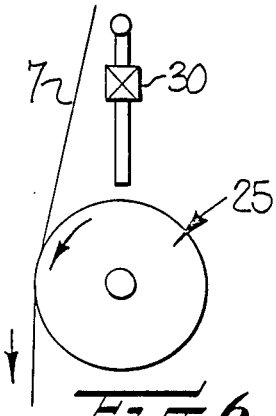
FIG. 6 is a side elevation view of the apparatus shown in FIG. 5.

FIGS. 5–6 illustrate a further embodiment of a fluid applicator adapted for use with the present invention. In this embodiment, the applicator is in the form of a roll 25 having three circumferential surface portions 26 which serve as the running surface for each of three running filament bundles 7. The surface portions 26 are defined by intermediate surface portions 28 which have water repellant properties and which repel the water supplied to the surfaces. Water is supplied to the surface portions 26 from a storage tank 29 by means of the metering pumps 30, and the roll 25 is rotated by a motor 31, preferably in a direction such that the surface portions 26 rotate in the direction of the running bundles 27.

EXAMPLE 1:

As a specific example of the present invention, a 90f30 polyester yarn was spun, with godet 19 operating at a delivery speed of 4000 m/min. The bundle was first cooled in cooling shaft or chute 4 to about 90° C., and water was supplied through nozzle 6 which was heated to 80° C. The quantity of water was so adjusted that the inherent ability of the bundle to absorb the water was exceeded, with the quantity of the flowing water being 30 percent of the bundle weight.

The bundle then looped the braking surfaces 9, 10 at an angle of 35° by the adjustment of the depth of penetration of deflecting surface 11, which was looped at an angle of 70°. The overall length of contact between the bundle and braking surfaces was adjusted to about 25 mm, which can be adjusted by alteration of the overlap of the braking surfaces. It should be noted that, for reasons of the water content of the advancing bundle, the looping angle should not become so large that the bundle is deflected by more than about 60° from its vertical direction of advance. By the vertical arrangement of the braking surfaces, one below the other, and also by the displacement of the deflecting surfaces from the vertical bundle path at a predetermined angle, it is accomplished that the water spraying or dripping off may be returned to the bundle or, respectively, the braking or deflecting surfaces. Where it is no longer possible or desirable to increase the overall length of the braking surfaces by enlarging the looping angle, one or several additional braking surfaces may be added to lengthen it, for the aforesaid reasons, or also for geometrical reasons.

The amount of water sprayed from the filament bundle was relatively low and did not unfavorably effect the hydrodynamic braking effect. However, even this small amount of water was sufficient to cause a permanent fluid mist in the box 5. This humid atmosphere is seen to contribute to the performance of the process insofar as there is no evaporation of the water applied to the filament bundles.

The subsequent godet 19 was heated to 120° C. A usual spin finish was previously applied by applicator roll 16. The takeup system was operated so that a package with a stepwise precision winding was produced. To obtain a precision winding, the traversing speed was reduced proportionately to the spindle speed. The spindle speed decreases, since the package is driven at a constant surface speed. However, in a stepwise precision bank winding, the traversing speed is, from time to time, increased to substantially its initial value. It has turned out to be especially advantageous that this increase of the traversing speed has a hardly measurable influence on the yarn tension in the traversing triangle. However, when the heating of godet 19 was turned off, the yarn tension fluctuated greatly, as the traversing speed increased. Thus, heating the godet turns out to be an excellent way to form packages with a uniform yarn tension and hardness, and to also maintain the thus-produced, outstanding properties of the yarn when winding it to a package.

EXAMPLE 2:

In a cooling and spinning shaft 4, six bundles of polyethyleneterephthalate having 24 filaments each were spun and cooled to about 90° C. These bundles were guided side by side to a water applying jet 6 having six yarn guides. Water of 20° C. at a quantity of 11.5 ml/min. was supplied to each bundle. Afterwards the six bundles were guided to braking and deflection surfaces 9–11 in a side by side manner, and the bundles were wrapped on the surfaces 9 and 10 at an angle of 35° C. and on the surface 11 at 70° C. By changing the overlap of surface 11 with respect to surfaces 9 and 10 the tensile stress in each bundle was adjusted to 90 cN per yarn. The bundles were withdrawn from the braking surfaces by means of the godet 19 at a speed of 4.507 m/min. Godet 19 had a temperature of 145° C., and the godet was wrapped eight times by each bundle.

The spin finish applicator 16 was arranged downstream of the godet 19 and a usual spin finish was applied to the resulting yarn. Thereafter, the filaments of each yarn were entangled by means of the air jet 17. The yarns were then separately wound into packages 14 at a winding speed of 4.463 m/min. The polyester yarns 76f24 (76 dtex, 24 filaments) exhibited a tensile strength of 40 cN/dtex, an elongation of 22.5%, a boiling shrinkage of 5.6% and a yarn evenness (Uster normal) of 0.9%. They had twenty one entangling knots per meter and a content of spin finish of 0.72%.

EXAMPLE 3:

In a spinning and cooling shaft 4, there were spun four polyamide-6 bundles each of which had ten filaments, and which were subjected to the conditions similar to those of Example 2. The water supply in water jet 6 was 5.8 ml water at 20° C. per bundle. The overlap of braking surface 11 with respect to braking surfaces 9 and 10 was adjusted in such a way that the drawing force was 76 cN per bundle.

The godet 19 had a temperature of 100° C., and its surface speed was 3.917 m/min. Each bundle was wrapped around the godet and the angled roller eleven times. Each resulting yarn was wound into a package at a speed of 3.799 m/min. These yarns 44f10 (44 dtex, 10 filaments) had a tensile strength of 45 cN/dtex, an elongation of 40%, a boiling shrinkage of 14%, and a yarn evenness (Uster normal) of 0.8%. They had nineteen entangling knots per meter and a spin finish application of 0.78%.

In the drawings and specification, there has been set forth a preferred embodiment of the invention, and although specific terms are employed, they are used in a generic and descriptive sense only and not for purposes of limitation.

That which is claimed is:

1. A method of producing a flat polymeric yarn of uniform quality comprising the continuous steps of melt spinning a polymer to form a plurality of running filaments, combining the filaments so as to form a running bundle of filaments, supplying a metered quantity of fluid onto a surface so as to form a relatively narrow ribbon of fluid, guiding the running bundle of filaments into contact with said ribbon of fluid and in alignment therewith, and so as to apply a controlled quantity of the fluid to the bundle which is at least about 20 percent of the weight of the bundle, and so that the ability of the bundle to internally absorb the applied fluid is exceeded and the bundle is soaked with the fluid and the external surface of the bundle is surrounded by a fluid coating, guiding the fluid coated bundle in a vertical downward direction over a plurality of serially arranged curved braking surfaces, with the direction of curvature alternating between adjacent braking surfaces, and such that the bundle is deflected at an angle of less than 70° from the vertical as it moves between the braking surfaces, and the frictional forces between the bundle and braking surfaces are essentially hydrodynamic, and withdrawing the running bundle from the braking surfaces by contacting the bundle with draw roll means and so as to draw the bundle.

2. The method as defined in claim 1 wherein the running bundle is advanced at a speed of greater than 1000 m/min to the braking surfaces, and wherein the draw roll means imparts a speed of greater than 3500 m/min to the bundle.

3. The method as defined in claim 2 comprising the further step of applying a finish to the bundle subsequent to contacting the bundle with said draw roll means.

4. The method as defined in claim 2 comprising the further step of applying a finish to the bundle between the final braking surface and said draw roll means.

5. The method as defined in claim 1 wherein the fluid applied to the running bundle is heated to between about 50° to 90° C.

6. The method as defined in claim 1 wherein the quantity of the fluid applied to the running bundle is between about 25 percent to 35 percent of the weight of the running bundle.

7. The method as defined in claim 1 wherein the overall length of the braking surfaces and the bundle speed are adjusted with respect to each other such that the draw roll means subjects the bundle to a tension of between about 0.5 and 2 cN/dtex.

8. The method as defined in claim 1 comprising the further step of permitting the filaments to cool so that they have a temperature within the range of the first order transition temperature of the polymer upon the running bundle being guided into contact with the fluid.

9. The method as defined in claim 1 wherein the step of guiding the running bundle into contact with the fluid includes applying the fluid on a stationary surface, and guiding the bundle across the stationary surface so as to draw the fluid in the direction of the running bundle.

10. The method as defined in claim 9 wherein the step of applying the fluid on the stationary surface includes positioning a fluid orifice on the stationary surface along the bundle path, and delivering the fluid through the orifice.

11. The method according to claim 1 wherein the viscosity of the fluid is not greater than that of water.

12. The method according to claim 11 wherein said fluid consists essentially of water.

13. The method as defined in claim 1 wherein said fluid comprises water and oil, with the oil comprising less than about 5 percent of the fluid by weight.

14. The method as defined in claim 1 wherein said fluid comprises water and a suitable wetting agent, with said wetting agent comprising less than about 1% by weight.

15. The method as defined in claim 1 wherein the step of guiding the fluid coated bundle over a plurality of serially arranged braking surfaces includes guiding the bundle over at least three such braking surfaces, with the direction of curvature alternating between each adjacent braking surface.

16. The method as defined in claim 1 comprising the further step of heating said draw roll means so as to heat the bundle upon being brought into contact therewith.

17. The method as defined in claim 16 wherein the polymer comprises polyester, and said draw roll means is heated to about 140°±20° C.

18. The method as defined in claim 16 wherein the polymer comprises polyamide, and said draw roll means is heated to about 100°±20° C.

19. The method as defined in claim 1 wherein the circumferential speed of said draw roll means is greater than 4000 m/min.

20. The method as defined in claim 1 wherein the filaments have a denier less than about 5.5 dtex.

21. The method as defined in claim 1 wherein the running bundle has a denier which is less than about 360 dtex.

22. The method as defined in claim 1 comprising the further step of contacting the running bundle with a jet of air at location downstream of said draw roll means, and so as to impart entanglements to the tilaments of the bundle.

23. The method as defined in claim 1 wherein the step of withdrawing the running bundle includes drawing the bundle to an extent exceeding the elastic limit of the bundle.

* * * * *